US011362452B2

(12) United States Patent
Lee et al.

(10) Patent No.: US 11,362,452 B2
(45) Date of Patent: Jun. 14, 2022

(54) MULTI-CONNECTION DEVICE

(71) Applicants: Samsung Electronics Co., Ltd., Gyeonggi-do (KR); Hyupjinconnector Co., Ltd., Gyeonggi-do (KR)

(72) Inventors: Sung-Hyup Lee, Gyeonggi-do (KR); Jae-Woon Lee, Gyeonggi-do (KR); Yong-Seok Lee, Seoul (KR); Yang-Jean Park, Gyeonggi-do (KR); Jin-Woo Park, Gyeonggi-do (KR)

(73) Assignees: Samsung Electronics Co., Ltd, Suwon-si (KR); Hyupjinconnector Co., Ltd, Ansan-si (KR)

( * ) Notice: Subject to any disclaimer, the term of this patent is extended or adjusted under 35 U.S.C. 154(b) by 179 days.

(21) Appl. No.: 16/499,378

(22) PCT Filed: Mar. 22, 2018

(86) PCT No.: PCT/KR2018/003372
§ 371 (c)(1),
(2) Date: Sep. 30, 2019

(87) PCT Pub. No.: WO2018/182235
PCT Pub. Date: Oct. 4, 2018

(65) Prior Publication Data

US 2020/0052427 A1 Feb. 13, 2020

(30) Foreign Application Priority Data

Mar. 31, 2017 (KR) ..... 10-2017-0041672

(51) Int. Cl.
*H01R 13/24* (2006.01)
*H01R 13/46* (2006.01)

(52) U.S. Cl.
CPC ..... *H01R 13/24* (2013.01); *H01R 13/46* (2013.01)

(58) Field of Classification Search
CPC ..... H01R 13/24; H01R 13/46
See application file for complete search history.

(56) References Cited

U.S. PATENT DOCUMENTS 6,406,305 B1 * 6/2002 Wu ..... H01R 12/52 439/629
7,803,011 B1 * 9/2010 Mai ..... H01R 13/2428 439/500
8,016,610 B1 * 9/2011 Lee ..... H01M 50/50 439/500
8,523,618 B2 * 9/2013 Ju ..... H01R 24/542 439/816
9,985,368 B2 * 5/2018 Deng ..... H01R 12/714
(Continued)

FOREIGN PATENT DOCUMENTS

KR 10-1370175 B1 3/2014
KR 10-1397284 B1 6/2014
(Continued)

*Primary Examiner* — Abdullah A Riyami
*Assistant Examiner* — Nader J Alhawamdeh
(74) *Attorney, Agent, or Firm* — Cha & Reiter, LLC

(57) ABSTRACT

A multi-connection device according to various embodiments of the present invention may comprise: a housing; and a first or a second connection terminal for electrical connection, the first and second connection terminals protruding in first and second directions from the housing, respectively. Various other embodiments may also be possible.

15 Claims, 16 Drawing Sheets

(56) References Cited

U.S. PATENT DOCUMENTS

| | | | | |
|---|---|---|---|---|
| 10,135,199 | B1 * | 11/2018 | Ju | H01R 12/714 |
| 10,181,664 | B2 * | 1/2019 | Murata | H01R 12/714 |
| 2011/0063186 | A1 * | 3/2011 | Park | H01R 12/718<br>343/892 |
| 2011/0177718 | A1 * | 7/2011 | Shen | H01R 12/714<br>439/625 |
| 2015/0111400 | A1 * | 4/2015 | Hashiguchi | H01R 12/714<br>439/66 |
| 2016/0294095 | A1 * | 10/2016 | Kim | H01R 12/7076 |
| 2018/0358722 | A1 * | 12/2018 | Park | H01R 12/51 |
| 2019/0013598 | A1 * | 1/2019 | Wu | H01R 13/502 |

FOREIGN PATENT DOCUMENTS

| | | | |
|---|---|---|---|
| KR | 10-2015-0096986 | A | 8/2015 |
| KR | 10-2016-0101652 | A | 8/2016 |

* cited by examiner

MULTI-CONNECTION DEVICE

CLAIM OF PRIORITY

This application is a National Phase Entry of PCT International Application No. PCT/KR2018/003372, which was filed on Mar. 22, 2018, and claims a priority to Korean Patent Application No. 10-2017-0041672, which was filed on Mar. 31, 2017, the contents of which are incorporated herein by reference.

TECHNICAL FIELD

Various embodiments of the present disclosure relate to a multi-connection device mounted in an electronic device.

BACKGROUND ART

An electronic device refers to a device that executes a specific function according to a loaded program, such as a home appliance, an electronic notebook, a portable multimedia player (PMP), a mobile communication terminal, a tablet personal computer (PC), a video/audio player, a desktop/laptop computer, an in-vehicle navigator, and so on. For example, these electronic devices may output stored information visually or audibly. Along with an increase in the integration level of electronic devices and the increasing popularity of ultra-high speed, large-capacity wireless communication, a single mobile communication terminal has recently been equipped with various functions. For example, functions such as a communication function, an entertainment function such as gaming, a multimedia function such as music/video play, a communication and security function for mobile banking or the like, scheduling, and an electronic wallet may be integrated in one electronic device.

In general, a connection device may be adopted for electrical connection to an external lead line in various electronic devices such as a portable phone, an MP3 player, a PMP, a tablet PC, Galaxy S10, iPad, and an ebook terminal.

DETAILED DESCRIPTION OF THE INVENTION

Technical Problem

The connection device is designed in the form of a C-clip on the whole, with a bottom plate fixed to a board and an operation unit which is movable up and down and contacts an object. The operation unit may include a contact portion that makes a direct contact point with an electronic part, an elastic portion that provides elasticity to the contact portion, when the contact portion is contacted, and an absorption surface that couples the contact portion and the elastic portion to each other.

Once the electronic part contacts the contact portion, the connection device may appropriately distribute a deformation load by elastic deformation of the elastic portion, and keep the contact portion balanced, thereby enabling reliable contact. As such, the connection device may execute the function of electrically coupling electronic parts to each other.

The conventional C-clip type connection device may face the limitation that as the contact portion moves up and down, the electronic part is located on the top end of the operation unit parallel to the bottom plate.

According to various embodiments of the present disclosure, a multi-connection device is intended to electrically couple electronic parts to each other by further allowing lateral contact between the electronic parts without limiting the coupling between the electronic parts to up and down direction.

According to various embodiments of the present disclosure, a multi-connection device is intended to prevent deformation of a product and the decrease and loss of elasticity of the product caused by repeated pressing movements and lifting movements by restricting abnormal movement of an operation unit against external forces applied from various directions.

Technical Solution

According to various embodiments of the present disclosure, a multi-connection device may include a housing, a first contact terminal configured to protrude in a first direction from the housing for electrical coupling, and a second contact terminal configured to protrude in a second direction from the housing for electrical coupling.

According to various embodiments of the present disclosure, an electronic device including a multi-connection device may include a multi-connection device including a housing, a plurality of contact terminals protruding in a plurality of directions from the housing for electrical coupling, and a first part inserted into the housing.

According to various embodiments of the present disclosure, an electronic device including a multi-connection device may include a multi-connection device including a housing into which a first part is inserted and a plurality of contact terminals protruding in a plurality of directions from the housing, for electrical coupling, a second part electrically coupled to one of the plurality of contact terminals, and a third part electrically coupled to another of the plurality of contact terminals.

Advantageous Effects

As a multi-connection device according to various embodiments includes a first contact terminal protruding from a first surface of a housing and a second contact terminal protruding from a second surface of the housing, the multi-connection device may allow electrical lateral coupling between electronic parts without limiting the electronic parts to up and down positions.

Since an electronic device including a multi-connection device according to various embodiments of the present disclosure uses a first contact terminal and a second contact terminal, electronic parts may be arranged freely without being limited to up and down positions.

A multi-connection device and an electronic device including the multi-connection device according to various embodiments of the present disclosure include protection walls that protect a first contact terminal and a second contact terminal. Therefore, deformation failure and contact failure of the contact terminals may be reduced.

MODE FOR CARRYING OUT THE INVENTION

Figure 1:
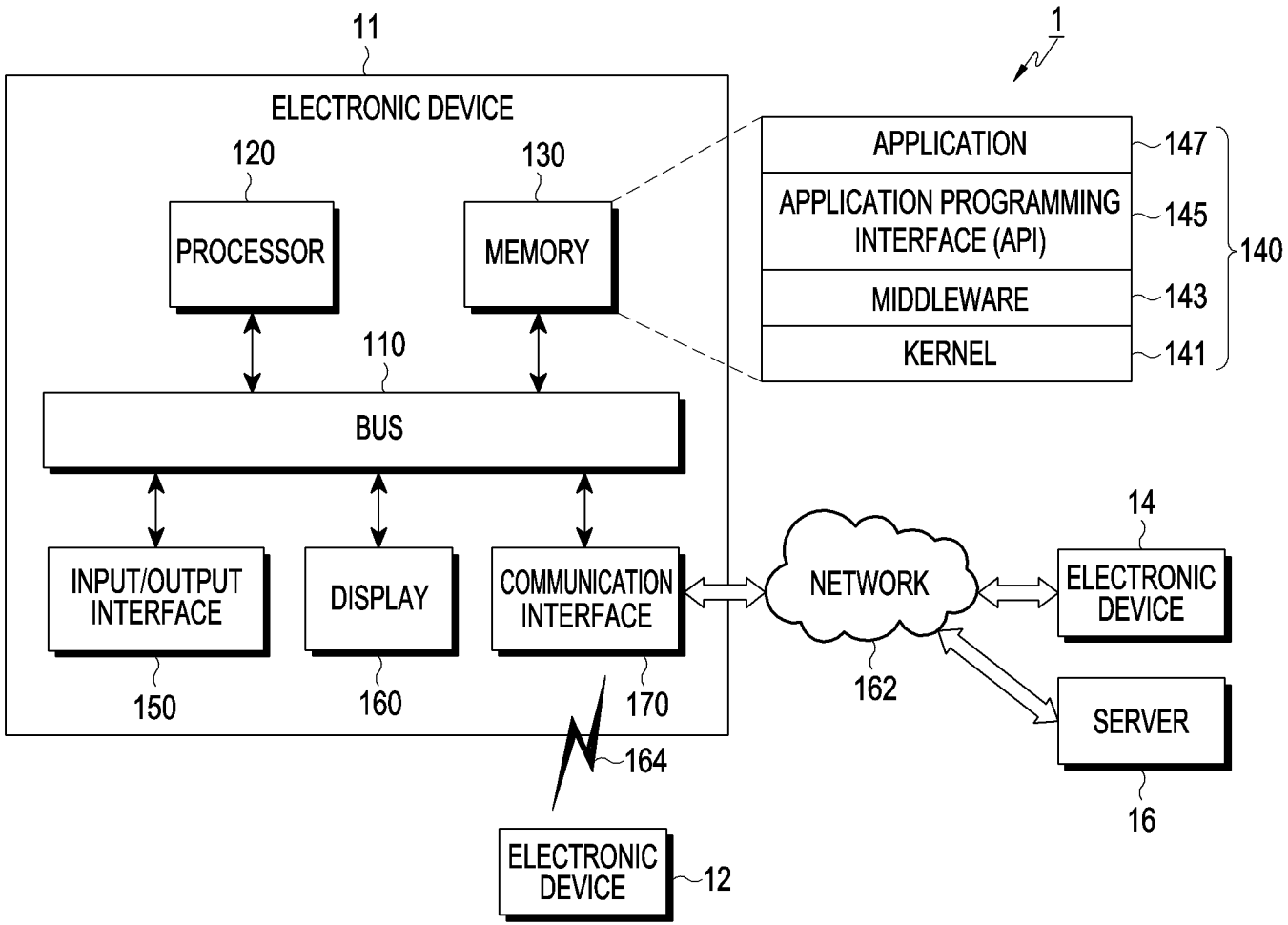
FIG. 1 is a schematic diagram illustrating an electronic device in a network environment according to various embodiments of the present disclosure.

Various embodiments of the present disclosure are described with reference to the accompanying drawings. However, the embodiments and the terms used herein are not intended to limit the technology described in various embodiments to the particular embodiments, and it is to be understood that the present disclosure covers various modifications, equivalents, or alternatives. With regard to the description of the drawings, similar reference numerals may be used to refer to similar elements. Singular forms include plural referents unless the context clearly dictates otherwise. In various embodiments of the present disclosure, each of such phrases as "A or B" and "at least one of A or B" may include all possible combinations of the items enumerated together in a corresponding one of the phrases. The term as used in the present disclosure, "$1^{st}$", "$2^{nd}$", "first" or "second" may be used for the names of various components irrespective of sequence and/or importance, not limiting the components. These expressions are used to distinguish one component from another component. When it is said that a component (e.g., a first component) is "(operatively or communicatively) coupled with/to" or "connected to" another component (e.g., a second component), it should be understood that the one component is connected to the other component directly or through any other component (e.g., a third component).

In various embodiments of the present disclosure, the term "configured to" may be interchangeably used with, for example, the term "suitable for", "having the capacity to", "designed to", "adapted to", "made to", or "capable of" under circumstances. Under some circumstances, the term "a device configured to" may mean that the device may be "capable of" with another device or part. For example, "a processor designed (or configured) to execute A, B, and C" may mean a dedicated processor (e.g., an embedded processor) for performing the corresponding operations or a generic-purpose processor (e.g., a central processing unit (CPU) or an application processor) for performing the operations by executing one or more software programs stored in a memory device.

An electronic device according to various embodiments of the present disclosure may include at least one of, for example, a smartphone, a tablet personal computer (PC), a mobile phone, a video phone, an e-book reader, a desktop PC, a laptop PC, a netbook computer, a workstation, a server, a personal digital assistant (PDA), a portable multimedia player (PMP), an MP3 player, mobile medical equipment, a camera, or a wearable device. According to various embodiments, the wearable device may include at least one of an accessory type (e.g., a watch, a ring, a bracelet, an ankle bracelet, a necklace, glasses, contact lenses, or a head-mounted device (HMD)), a fabric or clothes type (e.g., electronic clothes), a body-attached type (e.g., a skin pad or tattoo), or an implantable circuit. According to some embodiments, an electronic device may include at least one of, for example, a television, a digital versatile disk (DVD) player, an audio player, a refrigerator, an air conditioner, a vacuum cleaner, an oven, a microwave oven, a washer, an air purifier, a set-top box, a home automation control panel, a security control panel, a media box (e.g., Samsung HomeSync™, Apple TV™, or Google TV™), a game console (e.g., Xbox™ or PlayStation™), an electronic dictionary, an electronic key, a camcorder, or an electronic picture frame.

According to other embodiments, an electronic device may include at least one of a medical device (e.g., a portable medical meter (a blood glucose meter, a heart rate meter, a blood pressure meter, a body temperature meter, or the like), a magnetic resonance angiography (MRA) device, a magnetic resonance imaging (MRI) device, a computed tomography (CT) device, an imaging device, an ultrasonic device, or the like), a navigation device, a global navigation satellite system (GNSS), an event data recorder (EDR), a flight data recorder (FDR), an automotive infotainment device, a naval electronic device (e.g., a naval navigation device, a gyrocompass, or the like), an avionic electronic device, a security device, an in-vehicle head unit, an industrial or consumer robot, a drone, an automatic teller's machine (ATM) in a financial facility, a point of sales (POS) device in a shop, or an Internet of things device (e.g., a lighting bulb, various sensors, a sprinkler, a fire alarm, a thermostat, a street lamp, a toaster, sports goods, a hot water tank, a heater, a boiler, or the like). According to some embodiments, an electronic device may include at least one of furniture, part of a building/structure or a vehicle, an electronic board, an electronic signature receiving device, a projector, or various measuring devices (e.g., a water, electricity, gas or electromagnetic wave measuring device). According to various embodiments, an electronic device may be flexible, or may be one or a combination of two or more of the foregoing devices. An electronic device according to an embodiment of the disclosure is not limited to the foregoing devices. According to various embodiments of the disclosure, the term user may refer to a person or device (e.g., artificial intelligence electronic device) that uses an electronic device.

FIG. 1 is a schematic view illustrating an electronic device in a network environment 1 according to various embodiments of the present disclosure.

Referring to FIG. 1, an electronic device 11 in the network environment 1 according to various embodiments is described. The electronic device 11 may include a bus 110, a processor 120, a memory 130, an input/output (I/O) interface 150, a display 160, and a communication interface 170. In some embodiments, at least one of the components may be omitted from the electronic device 11 or a component may be added to the electronic device 11. The bus 110 may interconnect the foregoing components 110 to 170, and include a circuit which allows communication (e.g., transmission of control messages and/or data) between the foregoing components. The processor 120 may include one or more of a CPU, an application processor (AP), or a communication processor (CP). The processor 120 may, for example, execute computation or data processing related to control and/or communication of at least one other component of the electronic device 11.

The memory 130 may include a volatile memory or a non-volatile memory. The memory 130 may, for example, store instructions or data related to at least one other component of the electronic device 11. According to an embodiment, the memory 130 may store software or a program 140. The program 140 may include, for example, a kernel 141, middleware 143, an application programming interface (API) 145, or an application program (or "application") 147. At least a part of the kernel 141, the middleware 143, or the API 145 may be called an operating system (OS). The kernel 141 may control or manage system resources (e.g., the bus 110, the processor 120, or the memory 130) that are used in executing operations or functions implemented in other programs (e.g., the middleware 143, the API 145, or the application programs 147). Also, the kernel 141 may provide an interface for allowing the middleware 143, the API 145, or the application programs 147 to access individual components of the electronic device 11 and control or manage system resources.

The middleware 143 may serve as a medium through which the kernel 141 may communicate with, for example, the API 145 or the application programs 147 to transmit and receive data. Also, the middleware 143 may process one or more task requests received from the application programs 147 according to priority levels. For example, the middleware 143 may assign priority levels for using system resources (e.g., the bus 110, the processor 120, or the memory 130) of the electronic device 11 to at least one of the application programs 147, and process the one or more task requests according to the priority levels assigned to the at least one application program 147. The API 145 is an interface through which the application programs 147 control functions provided by, for example, the kernel 141 or the middleware 143. For example, the API 145 may include at least one interface or function (e.g., a command) for file control, window control, video processing, or text control. The I/O interface 150 may output a command or data received from the user or an external device to the other component(s) of the electronic device 11 or output a command or data received from the other component(s) of the electronic device 11 to the user or the external device.

The display 160 may include, for example, a liquid crystal display (LCD), a light emitting diode (LED) display, an organic LED (OLED) display, a microelectromechanical systems (MEMS) display, or an electronic paper display. The display 160 may display, for example, various types of content (e.g., text, an image, a video, an icon, or a symbol) to the user. The display 160 may include a touch screen and receive, for example, a touch input, a gesture input, a proximity input, or a hovering input through an electronic pen or a user's body part. The communication interface 170 may establish communication, for example, between the electronic device 11 and an external device (e.g., a first external electronic device 12, a second external electronic device 14, or a server 16). For example, the communication interface 170 may be connected to a network 162 by wireless communication or wired communication and communicate with the external device (e.g., the second external electronic device 14 or the server 16 over the network 162.

The wireless communication may include cellular communication using, for example, at least one of long-term evolution (LTE), LTE-Advanced (LTE-A), code division multiple access (CDMA), wideband CDMA (WCDMA), universal mobile telecommunication system (UMTS), Wireless Broadband (WiBro), or global system for mobile communications (GSM). According to an embodiment, the wireless communication may include, as indicated by reference numeral 164 in FIG. 1, at least one of, for example, wireless fidelity (WiFi), light fidelity (LiFi), Bluetooth, Bluetooth low energy (BLE), Zigbee, near field communication (NFC), magnetic secure transmission (MST), radio frequency (RF), or body area network (BAN). According to an embodiment, the wireless communication may include global navigation satellite system (GNSS). GNSS may be, for example, global positioning system (GPS), global navigation satellite system (Glonass), Beidou navigation satellite system (hereinafter, referred to as "Beidou"), or Galileo, the European global satellite-based navigation system. According to an embodiment, the terms "GPS" and "GNSS" are interchangeably used with each other. The wired communication may include, for example, at least one of universal serial bus (USB), high definition multimedia interface (HDMI), recommended standard 232 (RS-232), or plain old telephone service (POTS). The network 162 may be a telecommunication network, for example, at least one of a computer network (e.g., LAN or WAN), the Internet, or a telephone network.

Each of the first and second external electronic devices 12 and 14 may be of the same type as or a different type from the electronic device 11. According to various embodiments, all or a part of operations performed in the electronic device 11 may be performed in one or more other electronic devices (e.g., the electronic devices 12 and 14) or the server 106. According to an embodiment, if the electronic device 11 is to perform a function or a service automatically or upon request, the electronic device 11 may request at least a part of functions related to the function or the service to another device (e.g., the electronic device 12 or 14 or the server 16), instead of performing the function or the service autonomously, or additionally. The other electronic device (e.g., the electronic device 14 or 14 or the server 16) may execute the requested function or an additional function, and provide a result of the function execution to the electronic device 11. The electronic device 11 may provide the requested function or service based on the received result or by additionally processing the received result. For this purpose, for example, cloud computing, distributed computing, or client-server computing may be used.

Figure 2:
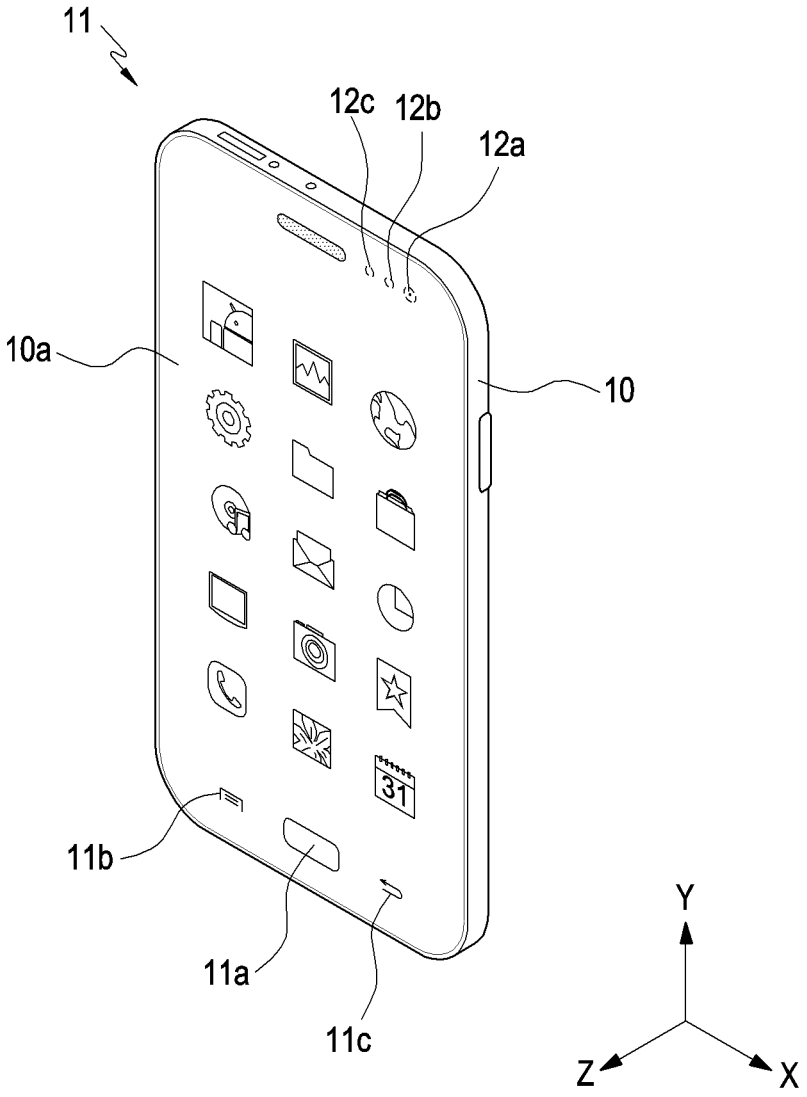
FIG. 2 is a front perspective view illustrating an electronic device according to various embodiments of the present disclosure.
Figure 3:
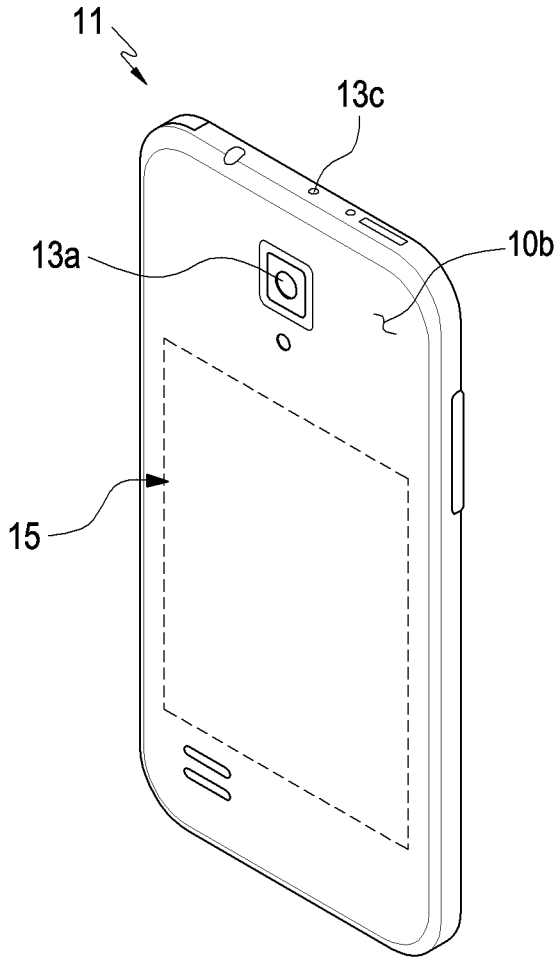
FIG. 3 is a rear perspective view illustrating an electronic device according to one of various embodiments of the present disclosure.

FIG. 2 is a front perspective view illustrating an electronic device according to various embodiments of the present disclosure. FIG. 3 is a rear perspective view illustrating an electronic device according to one of various embodiments of the present disclosure.

Referring to FIG. 2, in a 3-axis Cartesian coordinate system, 'X' may represent the width direction of the electronic device 11, 'Y' may represent the length direction of the electronic device 11, and 'Z' may represent the thickness direction of the electronic device 11.

As illustrated in FIGS. 2 and 3, the electronic device 11 may include a body 10. The body 10 may include a first surface 10*a* facing in a first direction +Z and a second surface 10*b* facing in a second direction −Z opposite to the first direction +Z. The body 10 may be open on the front surface thereof, and a transparent cover may be mounted to form at least part of the first surface 10*a*, closing the open front surface of the body 10. In another example, the transparent cover may be disposed on the entirety of the front surface of the electronic device 11, when seen from above the first surface 10*a*.

According to an embodiment, a keypad including mechanical buttons or touch keys 11*a*, 11*b*, and 11*c* may be provided in an area of the front surface (e.g., the first surface 10*a*) of the body 10. The touch keys may generate input signals, upon contact of a user's body. According to various embodiments, the keypad may be configured with mechanical buttons only or touch keys only. The body 10 may accommodate various circuit devices, for example, the afore-described processor 120, memory 130, I/O interface 150, and communication interface 170 therein. Further, the body 10 may accommodate a battery 15 therein, thereby securing a power source.

According to an embodiment of the present disclosure, a first camera 12*a*, an illumination sensor 12*b*, or a proximity sensor 12*c* may be included in an upper end area of the front surface of the electronic device 11. In another example, the electronic device 11 may be provided, on the rear surface thereof, with a second camera 13*a*, a flash, or a speaker 13*c*.

Figure 4:
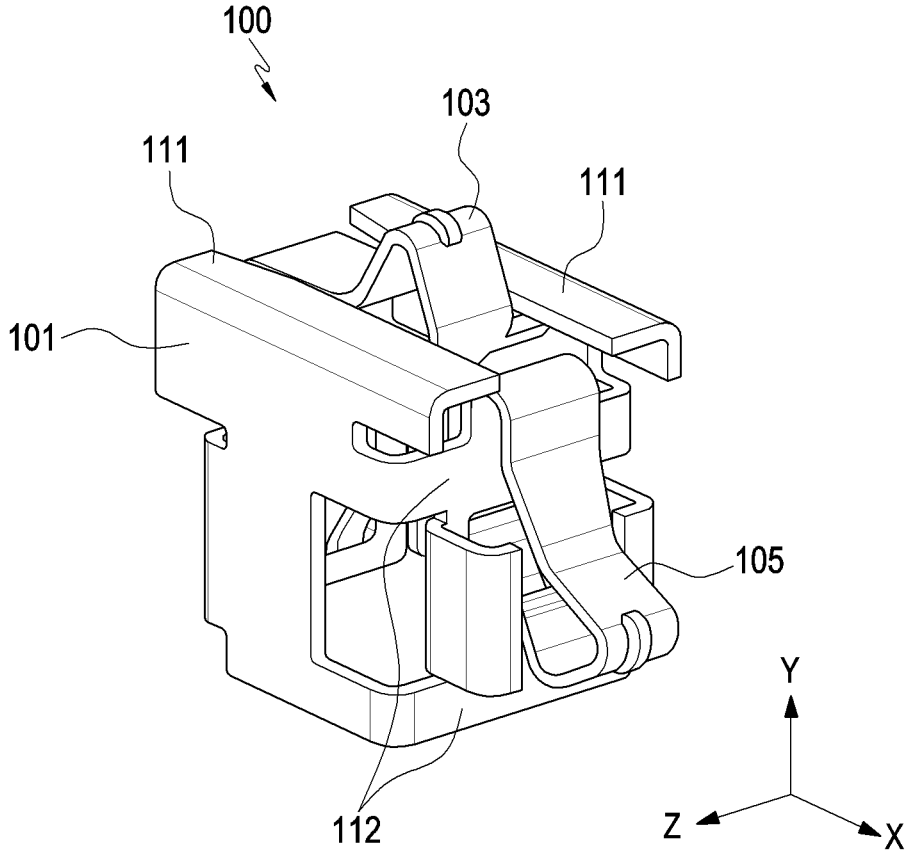
FIG. 4 is a perspective view illustrating the front surface of a multi-connection device in an electronic device according to one of various embodiments of the present disclosure.

FIG. 4 is a perspective view illustrating the front surface of a multi-connection device 100 in an electronic device (e.g., the electronic device 11 in FIG. 2) according to one of various embodiments of the present disclosure.

Referring to FIG. 4, the multi-connection device 100 in the electronic device (e.g., the electronic device 11 in FIG. 2) according to one of various embodiments of the present disclosure may include a housing 101 and a plurality contact terminals 103 and 105. The multi-connection device 100 may reside in a body (e.g., the body 10 in FIG. 2) of the electronic device (e.g., the electronic device 11 in FIG. 2).

According to an embodiment, the plurality of contact terminals 103 and 105 may include a first contact terminal 103 and a second contact terminal 105. According to an embodiment, the plurality of contact terminals 103 and 105 may include three or more contact terminals, not limited to the first and second contact terminals 103 and 105.

According to an embodiment, the housing 101 may be disposed inside the body (e.g., the body 10 in FIG. 2) of the electronic device (e.g., the electronic device 11 in FIG. 2). The housing 101 may include a first surface 111 and a second surface 112. The second surface 112 may be perpendicular to the first surface 111.

According to an embodiment, the first contact terminal 103 may protrude from the first surface 11, coupled to the housing 101. For example, the first contact terminal 103 may protrude in a first direction (e.g., the Y-axis direction) from the housing 101. The first contact terminal 103 may make a pressing movement or lifting movement by elastic force.

According to an embodiment of the present disclosure, the second contact terminal 105 may protrude from the second surface 112, coupled to the housing 101. For example, the second contact terminal 105 may protrude in a second direction (e.g., the X axis direction perpendicular to the Y axis direction) from the housing 101. According to an embodiment, the second contact terminal 105 may protrude in a direction other than the protrusion direction of the first contact terminal 103. The second contact terminal 103 may make a pressing movement or lifting movement by elastic force.

Figure 5:
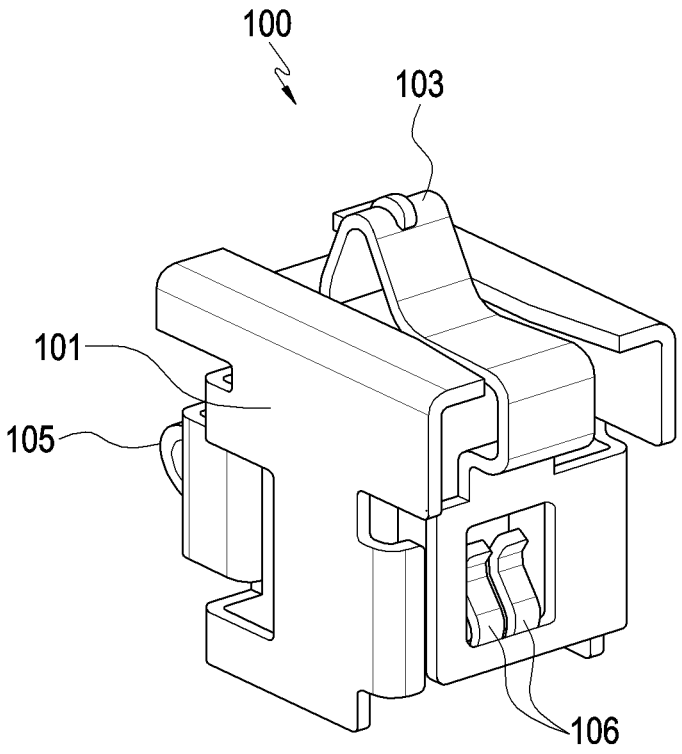
FIG. 5 is a perspective view illustrating the rear surface of a multi-connection device according to one of various embodiments of the present disclosure.

FIG. 5 is a perspective view illustrating the rear surface of a multi-connection device (e.g., the multi-connection device 100 in FIG. 4) in an electronic device (e.g., the electronic device 11 in FIG. 2) according to one of various embodiments of the present disclosure.

Referring to FIG. 5, according to an embodiment of the present disclosure, the multi-connection device 100 may include a first engagement portion 106. The first engagement portion 106 may be bent inward from a surface opposite to the second surface 101. For example, the first engagement portion 106 may be in the form of a hook. The first engagement portion 106 may be insertion-engaged in a groove of a first part (e.g., a first part 20 in FIG. 11) inserted into the housing 101. The first engagement portion 106 may fix the housing 101 to the first part (e.g., the first part 20 in FIG. 11).

Figure 6:
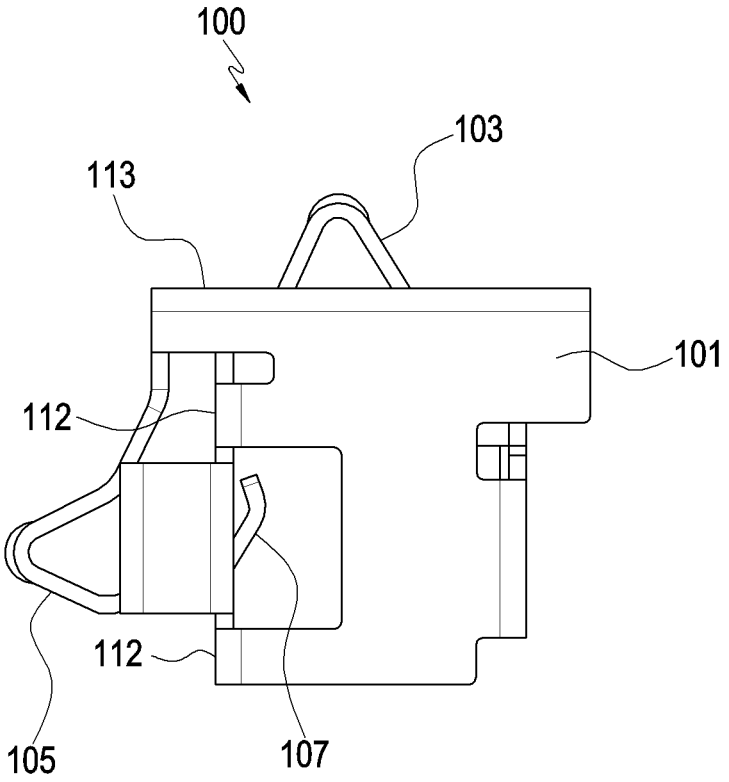
FIG. 6 is a side view illustrating a multi-connection device in an electronic device according to one of various embodiments of the present disclosure.

FIG. 6 is a side view illustrating a multi-connection device (e.g., the multi-connection device 100 in FIG. 5) in an electronic device (e.g., the electronic device 11 in FIG. 2) according to one of various embodiments of the present disclosure.

Referring to FIG. 6, the multi-connection device 100 according to one of various embodiments of the present disclosure may include a second engagement portion 107. The second engagement portion 107 may extend from a second surface (e.g., the second surface 112 in FIG. 4). The second engagement portion 107 may be in the form of a hook bent inward from the second surface (e.g., the second surface 112 in FIG. 4). The second engagement portion 107 together with the first engagement portion 106 may fix the housing 101 to the first part (e.g., the first part 20 in FIG. 11).

Figure 7:
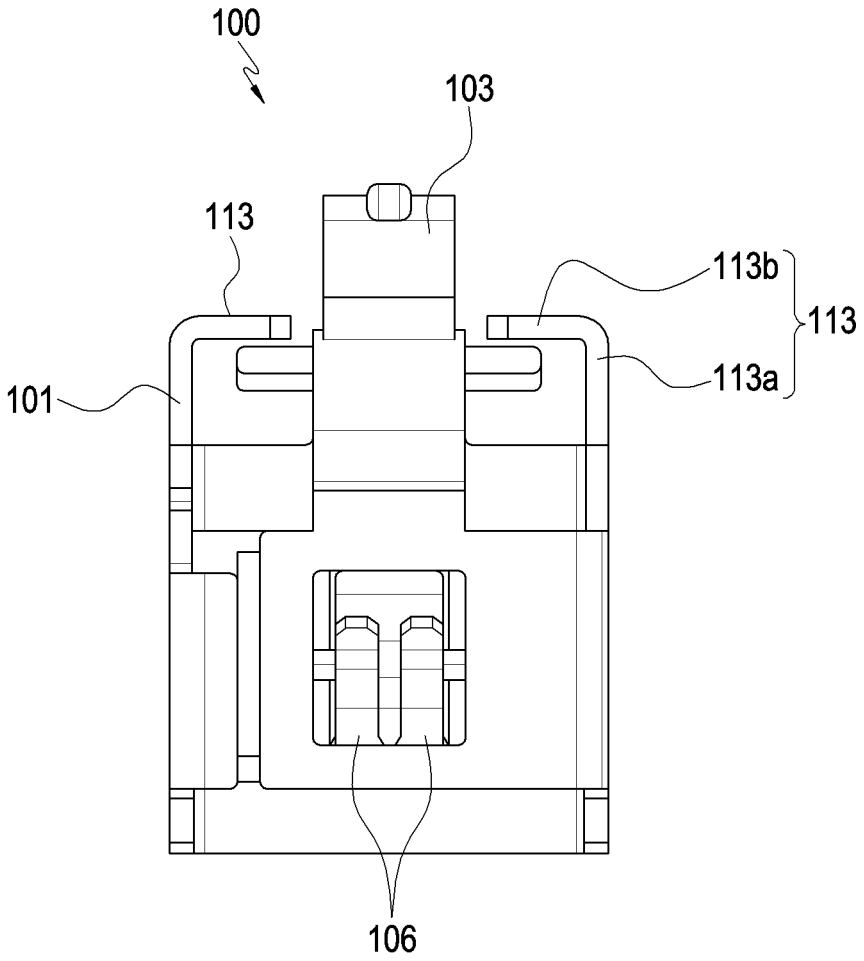
FIG. 7 is a rear view illustrating a multi-connection device in an electronic device according to one of various embodiments of the present disclosure.

FIG. 7 is a rear view illustrating a multi-connection device (e.g., the multi-connection device 100 in FIG. 6) in an electronic device (e.g., the electronic device 11 in FIG. 2) according to one of various embodiments of the present disclosure.

Referring to FIG. 7, the housing 101 of the multi-connection device 100 (e.g., the multi-connection device 100 in FIG. 6) according to one of various embodiments of the present disclosure may include first protection walls 113. The first protection walls 113 may be formed on a first surface (e.g., the first surface 111 in FIG. 4). The first protection walls 113 may be disposed along the peripheries of parts of the first contact terminal 103 (e.g., the first contact terminal 103 in FIG. 6). Each of the first protection walls 113 may include a side protection wall 113*a* and an extension portion 113*b*. The side protection walls 113*a* may protect side surfaces of the first contact terminal 103. The extension portions 113*b* may extend in a direction perpendicular to the side protection walls 113*a*, and limit the lifting movement of the first contact terminal 103.

Figure 8:
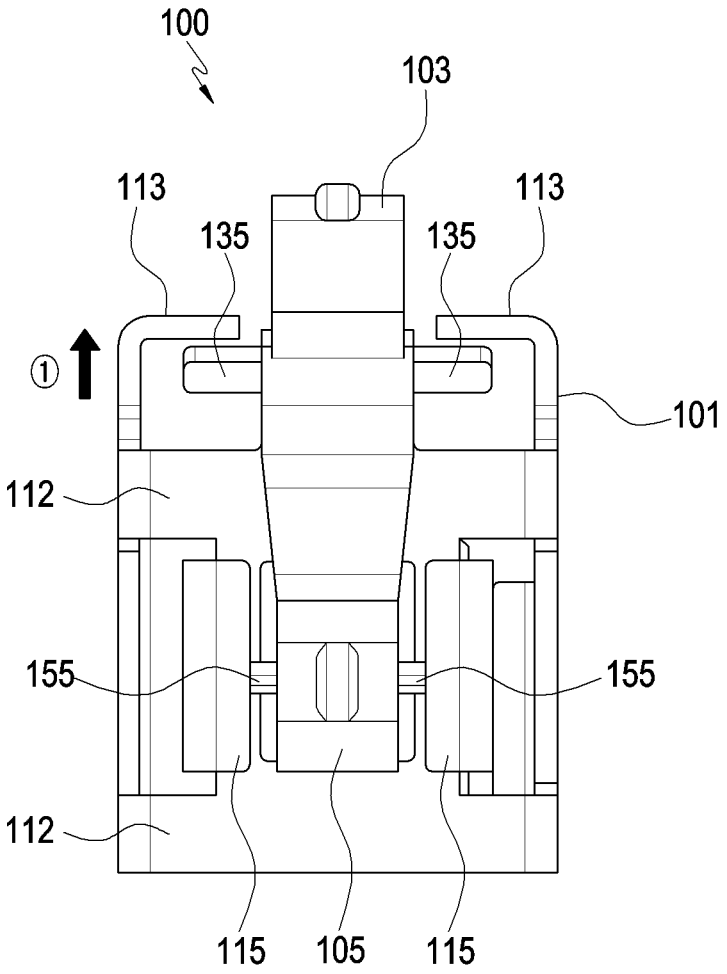
FIG. 8 is a front view illustrating a contact terminal in an electronic device according to one of various embodiments of the present disclosure.

FIG. 8 is a front view illustrating a multi-connection device (e.g., the multi-connection device 100 in FIG. 7) in an electronic device (e.g., the electronic device 11 in FIG. 2) according to one of various embodiments of the present disclosure.

Referring to FIG. 8, the housing 101 (e.g., the housing 101 in FIG. 7) of the multi-connection device 100 (e.g., the multi-connection device 100 in FIG. 7) according to an embodiment of the present disclosure may include second protection walls 115. The second protection walls 115 may extend from a second surface (e.g., the second surface 112 in FIG. 4). The second protection walls 115 may be disposed along the peripheries of parts of the second contact terminal 105 (e.g., the second contact terminal 105 in FIG. 6).

According to an embodiment of the present disclosure, the multi-connection device 100 may further include first lifting stop portions 135. The first lifting stop portions 135 may extend from the first contact terminal 103 and be caught by the extension portions 113*b*. For example, when the first contact terminal 103 moves in a first direction ① by elastic force, the first lifting stop portions 135 may be caught by the extension portions 113*b*, thereby preventing the decrease of the elastic force of the first contact terminal 103.

Figure 9:
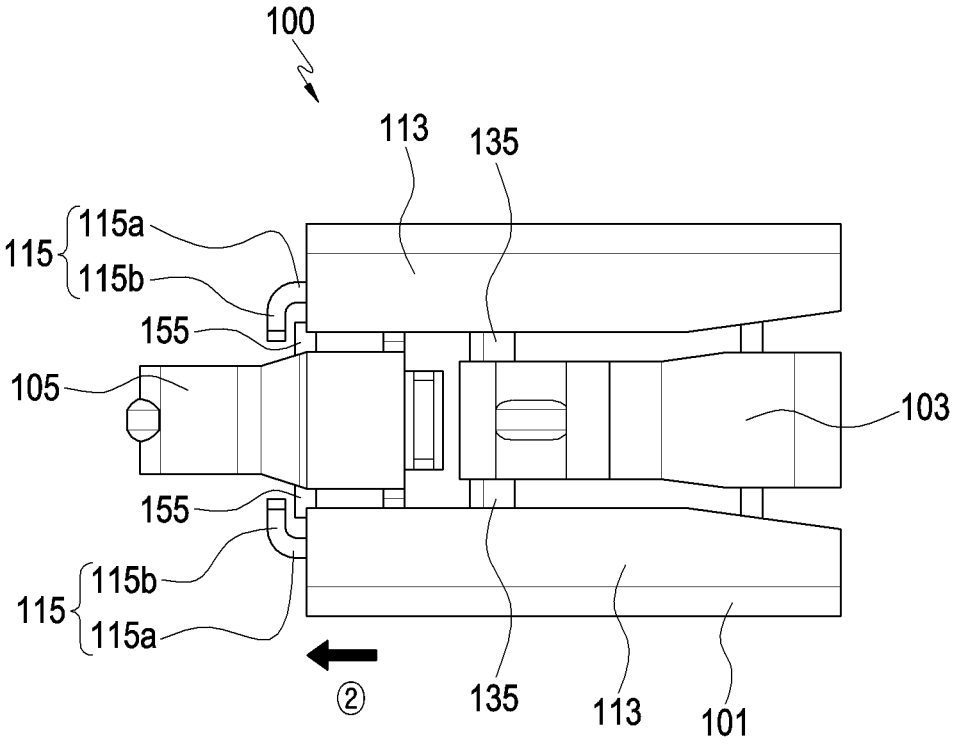
FIG. 9 is a plane view illustrating a multi-connection device in an electronic device according to one of various embodiments of the present disclosure.

FIG. 9 is a plan view illustrating a multi-connection device (e.g., the multi-connection device 100 in FIG. 8) in an electronic device (e.g., the electronic device 11 in FIG. 2) according to one of various embodiments of the present disclosure.

Referring to FIG. 9, each of the second protection walls 115 of the multi-connection device 100 (e.g., the multi-connection device 100 in FIG. 8) according to one of various embodiments of the present disclosure may include a side protection wall 115*a* and an extension portion 115*b*. The side protection walls 115*a* may protect side surfaces of the second contact terminal 105. The extension portions 115*b* may extend in a direction perpendicular to the side protection walls 115*a*, and limit the lifting movement of the second contact terminal 105.

Figure 10:
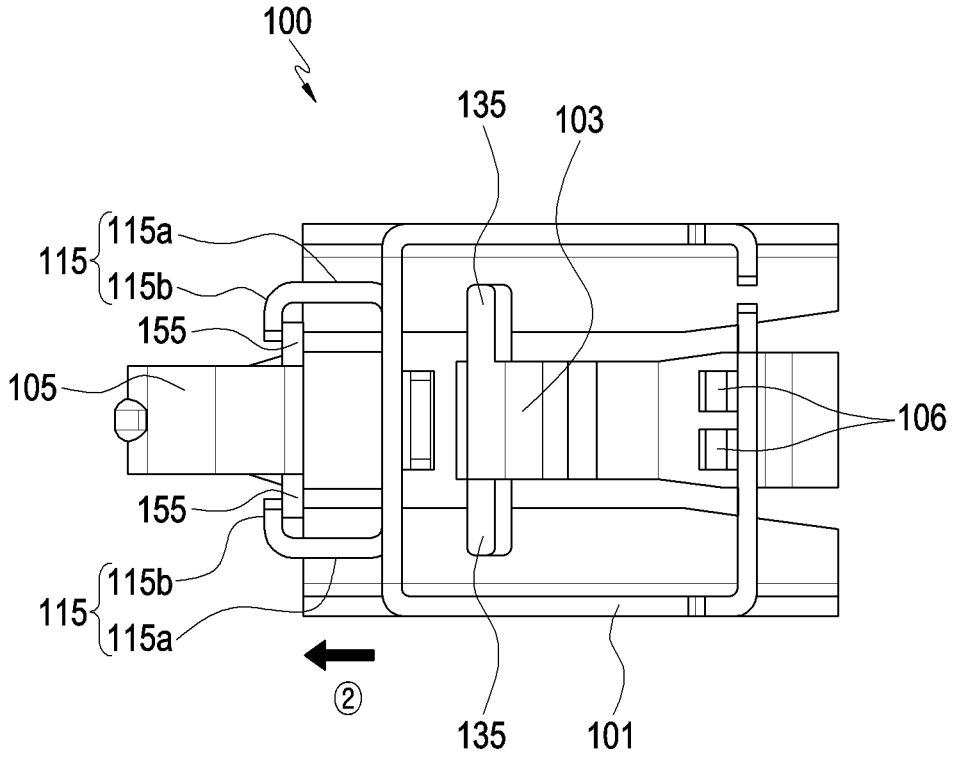
FIG. 10 is a bottom view illustrating a multi-connection device in an electronic device according to one of various embodiments of the present disclosure.

FIG. 10 is a bottom view illustrating a multi-connection device (e.g., the multi-connection device 100 in FIG. 7) in an electronic device (e.g., the electronic device 11 in FIG. 2) according to one of various embodiments of the present disclosure.

Referring to FIG. 10, the multi-connection device 100 (e.g., the multi-connection device 100 in FIG. 8) according to one of various embodiments of the present disclosure may include second lifting stop portions 155. The second lifting stop portions 155 may extend from the second contact terminal 105 and be caught by the extension portions 115*b*. For example, when the second contact terminal 105 moves in a second direction ② by elastic force, the second lifting stop portions 155 may be caught by the extension portions 115*b*, thereby preventing the decrease of the elastic force of the second contact terminal 105. The second direction ② may be perpendicular to the first direction (e.g., the first direction ① in FIG. 8).

Figure 11:
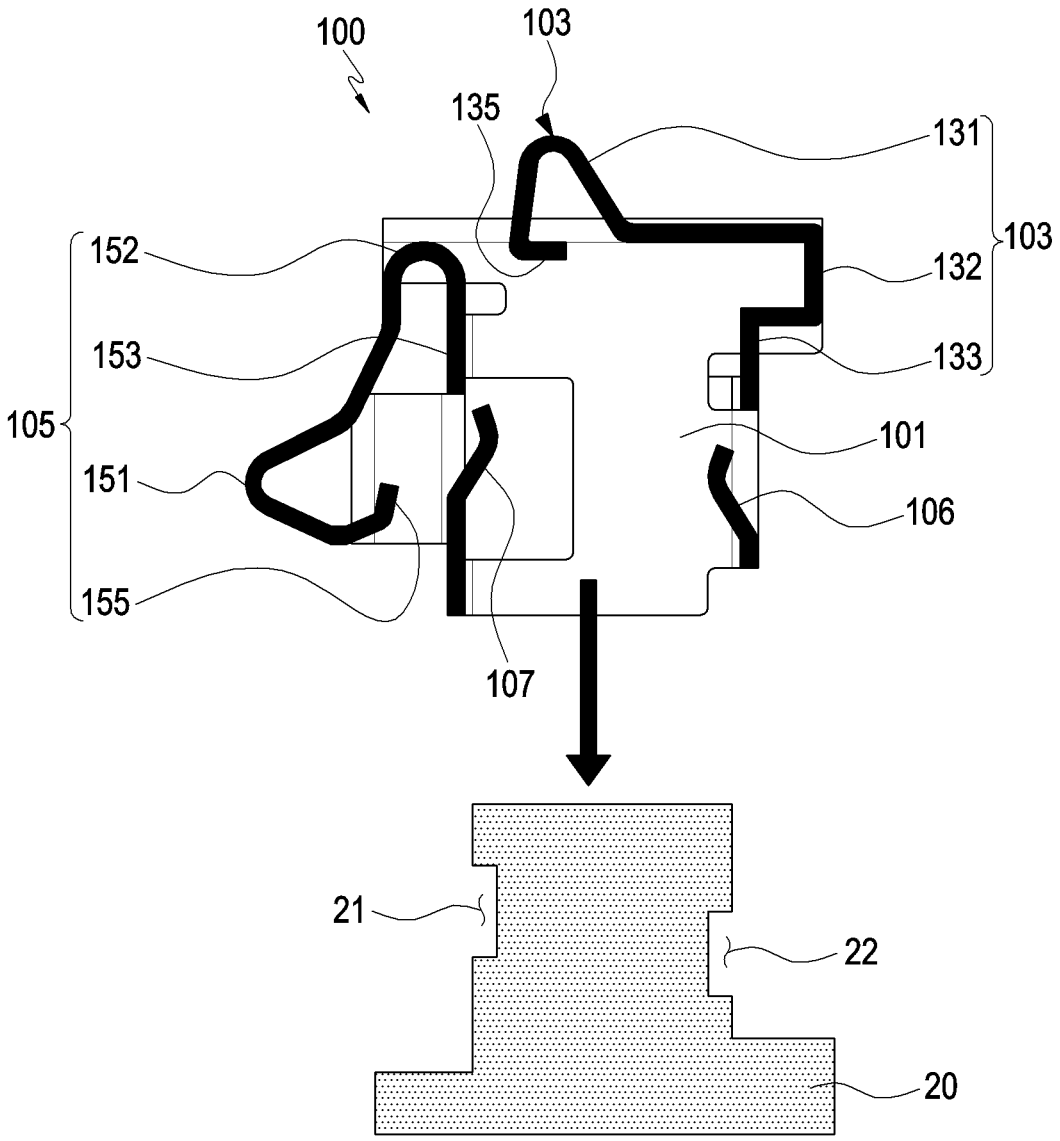
FIG. 11 is a sectional view illustrating a multi-connection device before the multi-connection device is engaged with a first part according to one of various embodiments of the present disclosure.

FIG. 11 is a sectional view illustrating a multi-connection device (e.g., the multi-connection device 100 in FIG. 10) in an electronic device (e.g., the electronic device 11 in FIG. 2) before the multi-connection device is engaged with the first part 20 according to one of various embodiments of the present disclosure. Referring to FIG. 11, the multi-connection device 100 (e.g., the multi-connection device 100 in FIG. 10) may be engaged with the first part 20. For example, the first part 20 may be inserted into and engaged with the housing 101.

According to an embodiment of the present disclosure, the first contact terminal 103 may include a first connection portion 133, a first operation portion 131, and a first bent portion 132. The first connection portion 133 may be brought into close contact with one surface of the first part 20. The first operation portion 131 may protrude from the first surface (e.g., the first surface 111 in FIG. 4) of the housing 101 and be pressed. The first bent portion 132 may connect between the first connection portion 133 and the first operation portion 131, and provide elastic force to the first operation portion 131.

According to an embodiment of the present disclosure, the second contact terminal 105 may include a second connection portion 153, a second operation portion 151, and a second bent portion 152. The second connection portion 153 may be brought into close contact with an opposite surface to the one surface of the first part 20. The second operation portion 151 may protrude from the second surface (e.g., the second surface 112 in FIG. 4) of the housing 101 and be pressed. The second bent portion 152 may connect between the second connection portion 153 and the second operation unit 151, and provide elastic force to the second operation portion 151.

According to an embodiment of the present disclosure, the first part 20 may include a first groove 22 and a second groove 21. The first engagement portion 106 may be insertion-engaged in the first groove 22. The second engagement portion 107 may be insertion-engaged in the second groove 21. As the first and second engagement portions 106 and 107 are insertion-engaged with the first and second grooves 22 and 21, the housing 101 may be engaged with the first part 20.

Figure 12:
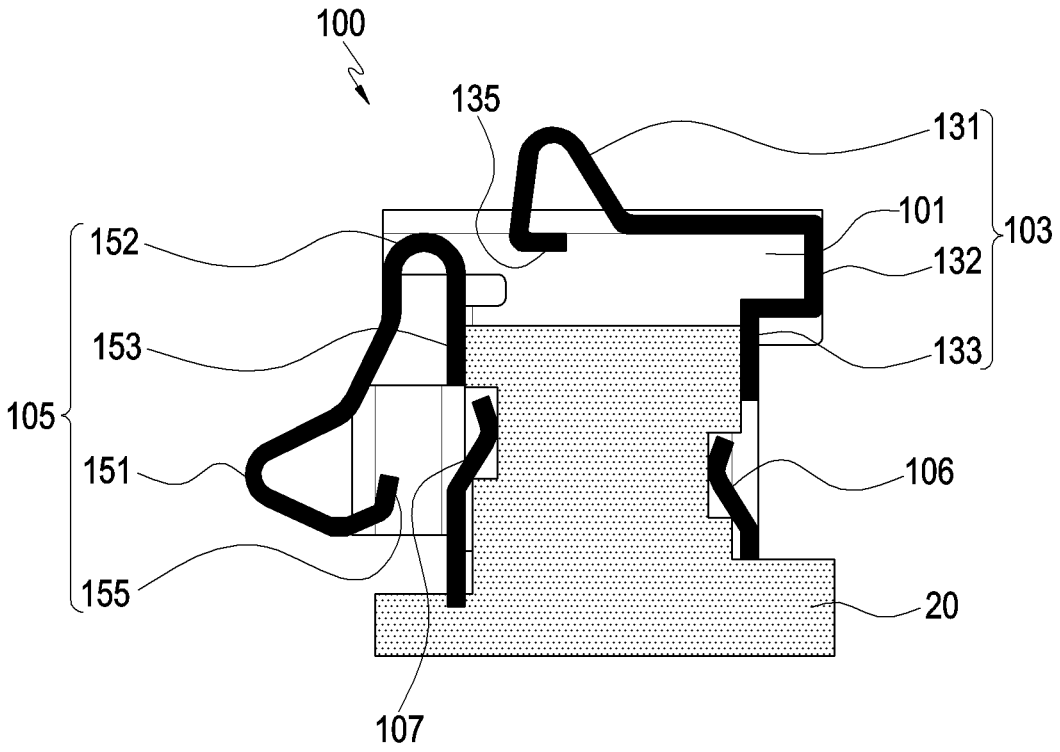
FIG. 12 is a sectional view illustrating a multi-connection device engaged with a first part according to one of various embodiments of the present disclosure.

FIG. 12 is a sectional view illustrating a multi-connection device (e.g., the multi-connection device 100 in FIG. 11) engaged with a first part in an electronic device (e.g., the electronic device 11 in FIG. 2) according to one of various embodiments of the present disclosure.

Referring to FIG. 12, the housing 101 of the multi-connection device 100 (e.g., the multi-connection device 100 in FIG. 11) according to one of various embodiments of the present disclosure may be engaged with and thus supported by the first part 20. For example, as the first and second engagement portions 106 and 107 are insertion-engaged in the first and second grooves 22 and 21, the housing 101 may be engaged with the first part 20.

Figure 13:
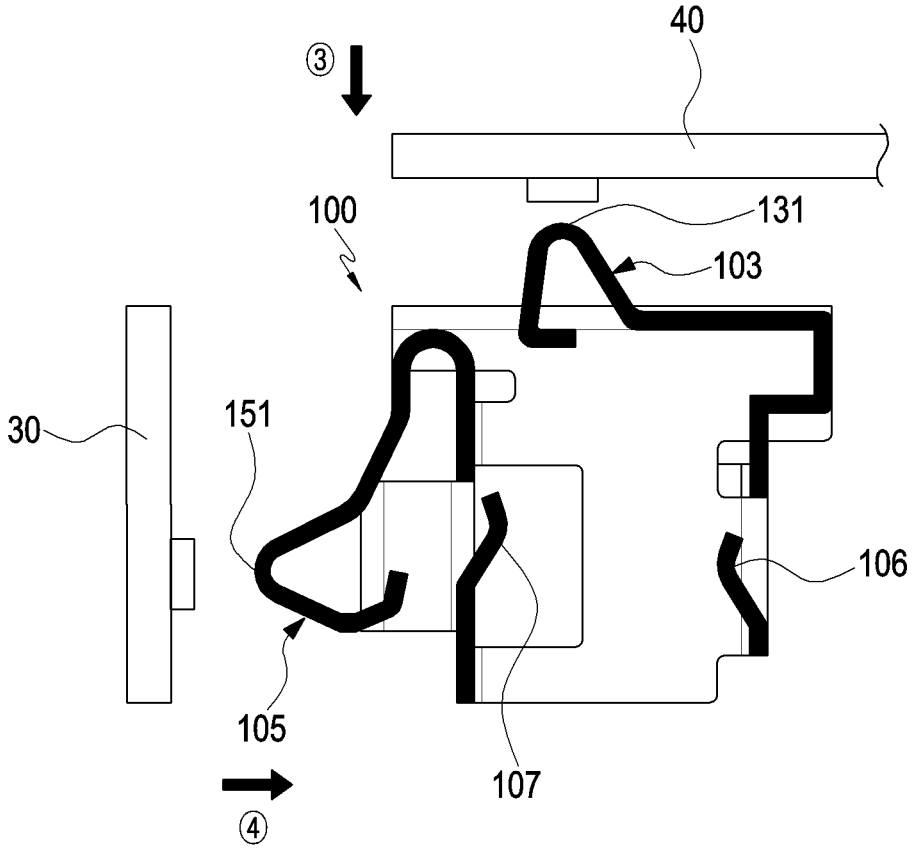
FIG. 13 is a sectional view illustrating a multi-connection device before the multi-connection device is engaged with second and third parts according to one of various embodiments of the present disclosure.

FIG. 13 is a sectional view illustrating a multi-connection device (e.g., the multi-connection device 100 in FIG. 12) in an electronic device (e.g., the electronic device 11 in FIG. 2) before the multi-connection device is engaged with second and third parts 40 and 30 according to one of various embodiments of the present disclosure. Referring to FIG. 13, the multi-connection device 100 (e.g., the multi-connection device 100 in FIG. 12) may be engaged with the second and third parts 40 and 30, respectively. The second part 40 may be a circuit board disposed in the body (e.g., the body 10 in FIG. 2) of the electronic device (e.g., the electronic device 11 in FIG. 2). According to an embodiment, the third part 30 may form part of the body 10 or a conductive electronic part mounted in the electronic device (e.g., the electronic device 11 in FIG. 2). The second part 40 may move along a third direction ③ and be electrically coupled to the multi-connection device 100. The third direction ③ may be opposite to the first direction (e.g., the first direction in FIG. 8). The third part 30 may move along a fourth direction ④ and be electrically coupled to the multi-connection device 100. The fourth direction ④ may be opposite to the second direction (e.g., the second direction ② in FIG. 10).

Figure 14:
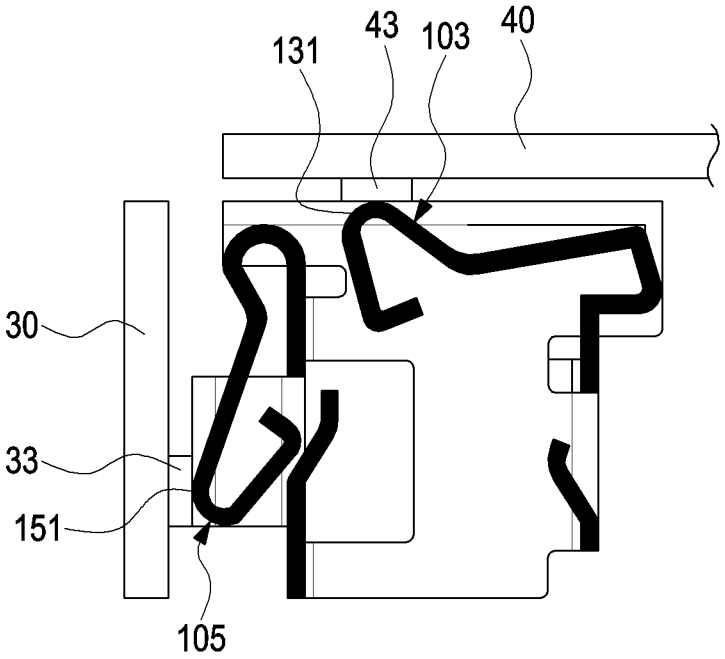
FIG. 14 is a sectional view illustrating a multi-connection device engaged with second and third parts according to one of various embodiments of the present disclosure.

FIG. 14 is a sectional view illustrating a multi-connection device (e.g., the multi-connection device 100 in FIG. 9) engaged with the second and third parts 40 and 30 in an electronic device (e.g., the electronic device 11 in FIG. 2) according to one of various embodiments of the present disclosure.

Referring to FIG. 14, a terminal 43 of the second part 40 may be coupled to the first contact terminal 103 of the multi-connection device 100. According to an embodiment, a terminal 33 of the third part 30 may be coupled to the second contact terminal 105 of the multi-connection device 100.

Figure 15:
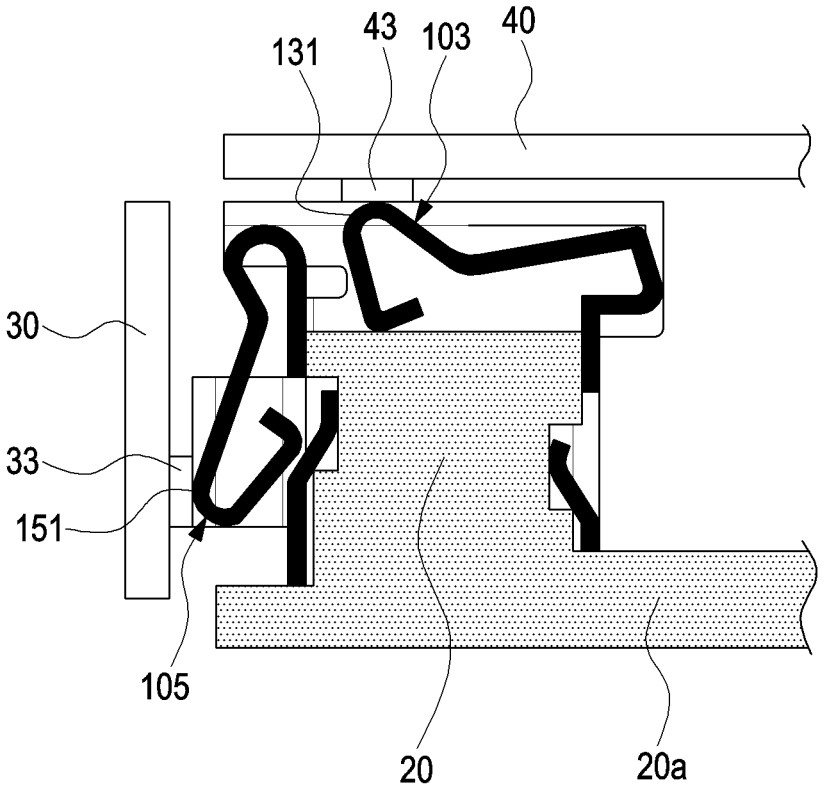
FIG. 15 is a sectional view illustrating a multi-connection device engaged with first, second, and third parts according to one of various embodiments of the present disclosure.

FIG. 15 is a sectional view illustrating a multi-connection device engaged with first, second, and third parts according to one of various embodiments of the present disclosure.

Referring to FIG. 15, the multi-connection device 100 according to one of various embodiments of the present disclosure may electrically couple the third part 30 as well as the second part 40.

According to an embodiment of the present disclosure, the first part 20 may be part of an electronic part 20*a* mounted in the electronic device (e.g., the electronic device 11 in FIG. 2). For example, the first part 20 may be formed to protrude from one surface of the electronic part 20*a*. The first part 20 may function to fix the multi-connection device 100.

According to an embodiment of the present disclosure, the second part 40 may be a circuit board mounted in the electronic device (e.g., the electronic device 11 in FIG. 2). According to an embodiment, the third part 30 may form part of the housing 101 or a conductive electronic part mounted in the electronic device (e.g., the electronic device 11 in FIG. 2).

According to an embodiment of the present disclosure, as the first contact terminal 103 is electrically coupled to the second part 40 and the second contact terminal 105 is electrically coupled to the third part 30, the second part 40 may be electrically coupled to the third part 30.

Figure 16:
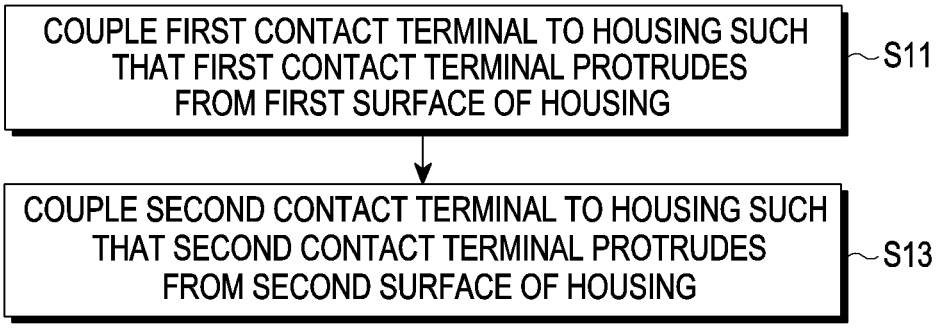
FIG. 16 is a flowchart illustrating a method of fabricating a multi-connection device in an electronic device according to one of various embodiments of the present disclosure.

FIG. 16 is a flowchart illustrating a method of fabricating a multi-connection device according to one of various embodiments of the present disclosure.

Referring to FIG. 16, the method of fabricating a multi-connection device according to one of various embodiments of the present disclosure may include coupling a first contact terminal to a housing such that the first contact terminal protrudes from a first surface of the housing (S11) and coupling a second contact terminal to the housing such that the second contact terminal protrudes from a second surface of the housing (S13).

Figure 17:
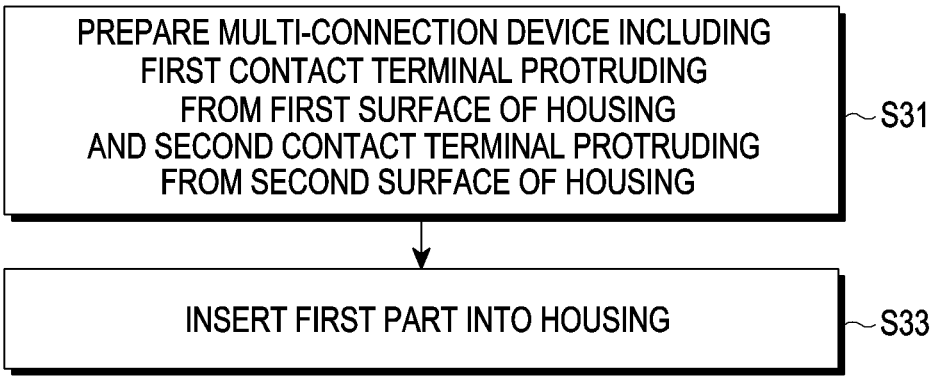
FIG. 17 is a flowchart illustrating a method of fabricating an electronic device including a multi-connection device according to one of various embodiments of the present disclosure.

FIG. 17 is a flowchart illustrating a method of fabricating an electronic device including a multi-connection device according to one of various embodiments of the present disclosure.

Referring to FIG. 17, the method of fabricating an electronic device including a multi-connection device according to one of various embodiments of the present disclosure may include preparing a multi-connection device including a first contact terminal protruding from a first surface of a housing and a second contact terminal protruding from a second surface of the housing (S31) and inserting a first part into the housing (S33).

According to an embodiment of the present disclosure, the method of fabricating an electronic device including a multi-connection device may further include coupling the first contact terminal to a second part and coupling the second contact terminal to a third part. According to an embodiment, operation for coupling the first contact terminal to the second part and operation for coupling the second contact terminal to the third part may not be performed sequentially.

As described above, according to various embodiments of the present disclosure, a multi-connection device may include a housing, and a first contact terminal configured to protrude in a first direction from the housing, for electrical coupling, and a second contact terminal configured to protrude in a second direction from the housing, for electrical coupling.

According to various embodiments of the present disclosure, the multi-connection device may further include a first part inserted into and engaged with the housing.

According to various embodiments of the present disclosure, the first contact terminal may be configured to protrude from a first surface of the housing, and the second contact terminal may be configured to protrude from a second surface of the housing.

According to various embodiments of the present disclosure, the first contact terminal may include a first connection portion configured to bring into close contact with a first surface of a first part, a first operation portion configured to protrude from a first surface of the housing and configured to make a pressing movement by contact with a second part or a lifting movement by elastic force, and a first bent portion configured to connect between the first connection portion and the first operation portion and configured to provide the elastic force to the first operation portion.

According to various embodiments of the present disclosure, the second contact terminal may include a second connection portion configured to bring into close contact with the first surface of the first part, a second operation portion configured to protrude from a second surface of the housing and configured to make a pressing movement by contact with a third part or a lifting movement by elastic force, and a second bent portion configured to connect between the second connection portion and the second operation portion and configured to provide the elastic force to the second operation portion.

According to various embodiments of the present disclosure, the first connection portion and the second connection portion may be disposed to face each other.

According to various embodiments of the present disclosure, a protrusion direction of the second operation portion of the second contact terminal may be different from a protrusion direction of the first operation portion of the first contact terminal.

According to various embodiments of the present disclosure, the protrusion direction of the second operation portion of the second contact terminal may be perpendicular to the protrusion direction of the first operation portion of the first contact terminal.

According to various embodiments of the present disclosure, the housing may include a first protection wall surrounding part of the first contact terminal, and a second protection wall surrounding part of the second contact terminal.

According to various embodiments of the present disclosure, the first protection may wall limit the lifting movements of the first operation portion, and the second protection walls may limit the lifting movements of the second operation portions.

According to various embodiments of the present disclosure, the first protection wall may include a side protection wall configured to protect a side surface of the first contact terminal, and an extension portion configured to extend from the side protection wall and configured to limit the lifting movement of the first operation portion of the first contact terminal, and the second protection wall may include a side protection wall configured to protect a side surface of the second contact terminal; and an extension portion configured to extend from the side protection wall and configured to limit the lifting movement of the second operation portion of the second contact terminal.

According to various embodiments of the present disclosure, the multi-connection device may further include a first lifting stop portions limiting lifting movements of the first operation portions of the first contact terminal, and a second lifting stop portion limiting lifting movements of the second operation portions of the second contact terminal.

According to various embodiments of the present disclosure, the first lifting stop portions may extend from end of the first operation portion of the first contact terminal and be caught by the extension portion of the first second protection wall, and the second lifting stop portion configured to extend from end of the second operation portion of the second contact terminal, and are caught by the extension portion of the second protection wall.

According to various embodiments of the present disclosure, the multi-connection device may further include a first engagement portion insertion-engaged in a first groove of the first part and engaging the housing with the first part, and a second engagement portion insertion-engaged in a second groove of the first part and engaging the housing with the first part.

According to various embodiments of the present disclosure, the first engagement portion may be in the form of a hook and insertion-engaged in first groove of the first part, and the second engagement portion may be in the form of a hook and insertion-engaged in the second groove of the first part.

According to various embodiments of the present disclosure, the housing may be coupled to the first and second contact terminals, surrounding parts of the first and second contact terminals.

According to various embodiments of the present disclosure, an electronic device including a multi-connection device may include a multi-connection device including a housing and a plurality of contact terminals protruding in a plurality of directions from the housing, for electrical coupling, and a first part configured to be insert into the housing.

According to various embodiments of the present disclosure, the plurality of contact terminals may are configured to protrude in different directions.

According to various embodiments of the present disclosure, an electronic device including a multi-connection device may include a multi-connection device including a housing into which a first part is inserted and a plurality of contact terminals protruding in a plurality of directions from the housing, for electrical coupling, a second part configured to be electrically coupled to one of the plurality of contact terminals or the first contact terminal, and a third part configured to be electrically coupled to another of the plurality of contact terminals or the second contact terminal.

According to various embodiments of the present disclosure, the second part may be a circuit board, and the third part may be formed of a conductive material.

While the disclosure has been described with reference to the particular embodiments, it is clear to those skilled in the art that many modifications can be made without departing from the scope and spirit of the disclosure.

The invention claimed is:

1. A multi-connection device internal to an electronic device, comprising:

a housing disposed within the electronic device;

a first contact terminal configured to protrude in a first direction from the housing; and a second contact terminal configured to protrude in a second direction from the housing, for electrical coupling; and a first engagement portion configured to being connected a first electronic component disposed within the electronic device, wherein the first and second contact terminals electrically couple two separate electronic components disposed within the electronic device, wherein the first contact terminal contacts a second electronic component disposed within the electronic device, the second contact terminal contacts a third electronic component disposed within the electronic device, wherein the first electronic component, the second electronic component and the third electronic component are separate from one another within the electronic device, and wherein the multi-connection device simultaneously contacts the first, second and third electronic components through the first and second contact terminals, and the first engagement portion.

2. The multi-connection device of claim 1, wherein the first engagement portion is further configured to receive insertion of a first part of the first electronic component disposed within the electronic device, to physically support the housing within the electronic device.

3. The multi-connection device of claim 2, wherein the first contact terminal is configured to protrude from a first surface of the housing, and the second contact terminal is configured to protrude from a second surface of the housing.

4. The multi-connection device of claim 1, wherein the first contact terminal comprises:

a first connection portion configured to bring into close contact with a first surface of a first part;

a first operation portion configured to protrude from a first surface of the housing and configured to make a pressing movement; and a first bent portion configured to connect between the first connection portion and the first operation portion and configured to provide an elastic force to the first operation portion.

5. The multi-connection device of claim 4, wherein the second contact terminal comprises:

a second operation portion configured to protrude from a second surface of the housing and configured to make a pressing movement; and a second bent portion configured to connect between a second connection portion and the second operation portion and configured to provide the elastic force to the second operation portion.

6. The multi-connection device of claim 5, wherein the first connection portion and the second connection portion are disposed to face each other.

7. The multi-connection device of claim 5, wherein a protrusion direction of the second operation portion of the second contact terminal is different from a protrusion direction of the first operation portion of the first contact terminal, and wherein the protrusion direction of the second operation portion of the second contact terminal is perpendicular to the protrusion direction of the first operation portion of the first contact terminal.

8. The multi-connection device of claim 5, wherein the housing comprises:

a first protection wall configured to surround part of the first contact terminal; and a second protection wall configured to surround part of the second contact terminal, and wherein the first protection wall is configured to limit a lifting movement of the first operation portion, and the second protection walls is configured to limit the lifting movement of the second operation portion, the first protection walls comprises:

a side protection wall configured to protect a side surface of the first contact terminal; and an extension portion configured to extend from the side protection wall of the first protection wall and configured to limit the lifting movement of the first operation portion of the first contact terminal, and the second protection wall comprises:

a side protection wall configured to protect a side surface of the second contact terminal; and an extension portion configured to extend from the side protection wall of the second protection wall and configured to limit the lifting movement of the second operation portion of the second contact terminal.

9. The multi-connection device of claim 8, further comprising a first lifting stop portion configured to limit a lifting movement of the first operation portion of the first contact terminal, and a second lifting stop portion configured to limit a lifting movement of the second operation portion of the second contact terminal, and wherein the first lifting stop portion configured to extend from an end of the first operation portion of the first contact terminal, and configured to be caught by the extension portion of the first protection wall, and the second lifting stop portion configured to extend from an end of the second operation portion of the second contact terminal, and configured to be caught by the extension portion of the second protection wall.

10. The multi-connection device of claim 3, further comprising a first engagement portion insertion-engaged in a first groove of the first part and engaging the housing with the first part, and a second engagement portion insertion-engaged in a second groove of the first part and engaging the housing with the first part, and wherein the first engagement portion is in a form of a hook and insertion-engaged in the first groove of the first part, and wherein the second engagement portion is in a form of a hook and insertion-engaged in the second groove of the first part.

11. The multi-connection device of claim 3, wherein the housing is coupled to the first and second contact terminals, surrounding parts of the first and second contact terminals.

12. The multi-connection device of claim 1, comprising:

a plurality of contact terminals protruding in a plurality of directions from the housing, for electrical coupling; and a first part configured to be inserted into the housing.

13. The multi-connection device of claim 12, wherein the plurality of contact terminals are configured to protrude in different directions.

14. The multi-connection device of claim 12, comprising:

a second part configured to be electrically coupled to one of the plurality of contact terminals or the first contact terminal; and a third part configured to be electrically coupled to another of the plurality of contact terminals or the second contact terminal.

15. The multi-connection device of claim 14, wherein the second part is a circuit board, and the third part is formed of a conductive material.

* * * * *